US006815155B2

(12) United States Patent
Taguchi

(10) Patent No.: US 6,815,155 B2
(45) Date of Patent: Nov. 9, 2004

(54) RADIOGRAPHIC IMAGING SYSTEM AND SILVER HALIDE PHOTOGRAPHIC MATERIAL

(75) Inventor: Masaaki Taguchi, Hino (JP)

(73) Assignee: Konica Corporation (JP)

( * ) Notice: Subject to any disclaimer, the term of this patent is extended or adjusted under 35 U.S.C. 154(b) by 23 days.

(21) Appl. No.: 10/326,753

(22) Filed: Dec. 20, 2002

(65) Prior Publication Data

US 2003/0138722 A1 Jul. 24, 2003

Related U.S. Application Data

(63) Continuation of application No. 09/801,178, filed on Mar. 5, 2001, now abandoned.

(30) Foreign Application Priority Data

Mar. 8, 2000 (JP) ..... 2000/063418

(51) Int. Cl.[7] ..... G03C 5/17; G03C 5/16

(52) U.S. Cl. ..... 430/508; 430/966; 430/967; 430/502; 430/139

(58) Field of Search ..... 430/508, 966, 430/967, 502, 567, 139; 378/101, 136, 140

(56) References Cited

U.S. PATENT DOCUMENTS 4,379,977 A * 4/1983 Carmel et al. ..... 378/136
4,414,304 A * 11/1983 Dickerson ..... 430/353
4,906,553 A * 3/1990 Ikegawa et al. ..... 430/401
5,221,846 A * 6/1993 Apple et al. ..... 250/483.1
5,272,499 A * 12/1993 Yamada ..... 396/619
5,462,832 A * 10/1995 Iwasaki ..... 430/139
5,475,229 A * 12/1995 Itabashi et al. ..... 250/483.1
5,541,047 A * 7/1996 Kashiwagi et al. ..... 430/522
5,840,472 A * 11/1998 Sasaki et al. ..... 430/488
5,853,945 A * 12/1998 Yamane et al. ..... 430/139
5,858,632 A * 1/1999 Taguchi ..... 430/440
6,048,675 A * 4/2000 Hirano et al. ..... 430/434
6,117,626 A * 9/2000 Yamane et al. ..... 430/509
6,329,662 B1 * 12/2001 Yamane et al. ..... 250/483.1
6,350,562 B2 * 2/2002 Watanabe et al. ..... 430/434
2001/0031038 A1 * 10/2001 Suzuki ..... 378/182
2002/0064725 A1 * 5/2002 Zegel et al. ..... 430/139

FOREIGN PATENT DOCUMENTS

EP 001136879 A1 * 3/2001 ..... G03C/5/17

* cited by examiner

*Primary Examiner*—Mark F. Huff
*Assistant Examiner*—Amanda Walke
(74) *Attorney, Agent, or Firm*—Muserlian, Lucas and Mercanti

(57) ABSTRACT

An radiographic imaging system for making a radiograph by a radiography apparatus using a photographic combination of a silver halide photographic light sensitive material in combination with intensifying screens, the photographic material comprising a support having a light sensitive silver halide emulsion layer on each both sides of the support, wherein the radiography apparatus conducts making a radiograph under the condition that a distance between a focal point of an X-ray tube and the photographic material is 0.9 to 3.0 m, a distance between the focal point of the X-ray tube and an object is 0.5 to 2.7 m and a distance between the object and the photographic combination is 0.3 to 1.5 m.

14 Claims, 4 Drawing Sheets

RADIOGRAPHIC IMAGING SYSTEM AND SILVER HALIDE PHOTOGRAPHIC MATERIAL

CROSS REFERENCE TO RELATED APPLICATIONS

This Application is a Continuation Application claiming the benefit under 35 U.S.C. 120 of U.S. patent application Ser. No. 09/801,178, filed Mar. 5, 2001 NOW ABANDONED.

FIELD OF THE INVENTION

The present invention relates to a radiographic imaging system and a silver halide photographic light sensitive material, thereby achieving enhanced image quality, and in particular to a noble radiographic imaging system exhibiting high sensitivity and superior image quality, whereby images exhibiting superior sharpness are obtained and which is suitable for magnification mammography.

BACKGROUND OF THE INVENTION

For diagnosis of breast cancer, specifically diagnosis of breast cancer at the initial stage, for example, is useful a photographic combination for mammographic use which is comprised of a radiographic intensifying screen and a silver halide photographic material (hereinafter, also referred to as a screen film system), whereby micro-calcification having a size of some hundreds micrometers or less can be detected at the initial stage of cancer. Specifically, relatively low speed photographic materials exhibiting superior graininess are employed in the conventional photographic combination for mammographic use. To enhance the detectability thereof, further enhanced sharpness in the screen film system has been desired. For example, a radiographic combination of a silver halide photographic material having a silver halide emulsion layer coated on only one side of a support (a so-called single-sided coated film) and a fluorescent screen (or X-ray intensifying screen) in the back screen arrangement is employed to achieve enhanced sharpness. Further, increasing the contrast of the single-sided coated film or prolonging the developing time in processing is conducted to achieve a contrast-increase in the film.

Although sharpness can be enhanced by a contrast-increase of the film, however, there occurs a self-inconsistency such that the contrast-increase results in deteriorated graininess. For example, not only observation of micro-calcification but also detection of a low contrast image of a tumor having a size of about 1 cm is dispensable in diagnosis of breast cancer. Accordingly, enhancement of sharpness without causing deterioration in graininess is desired in mammography.

Deterioration of graininess caused by a contrast-increase of the film can be improved by increasing the X-ray dose, which must be limited in terms of patient exposure to radiation. Further, an X-ray source of molybdenum is often employed for mammography since the use of an X-ray source giving high exposure to radiation is not suited. Furthermore, there have been made attempts of enhancing graininess of a silver halide photographic material but the size of silver halide grains used in the silver halide photographic material used for mammography is so small that this technique is close to its limitation.

Radiographic film for use in examination of breast cancer comprise a transparent support having a light sensitive emulsion layer only on one side of the support, which contains a relatively large amount of silver halide grains to achieve high contrast and a high density such as 3.5 or more, disadvantageously making rapid access difficult not only in developing but also in fixing, washing and drying.

In radiographic films having light sensitive emulsion layers on both sides of the support, the silver coverage per one side and the content of hydrophilic colloidal material can be easily reduced to provide suitability for rapid access or processing at a relatively low replenishing rate. However, such dual coated films have a concern of a lowering of sharpness, caused by crossover light, as compared to the single-sided coated film. It was found by the inventors of this invention that enhanced sharpness was achieved by the application of the radiography method of thin invention.

SUMMARY OF THE INVENTION

Accordingly, it is an object of the present invention to provide an radiographic imaging method by the use of a silver halide photographic material having light sensitive emulsion layers on opposite sides of the support, suitable for magnifying mammography exhibiting enhanced speed and superior sharpness.

The object of the invention can be accomplished by the following constitution:

(1) a radiographic imaging system for making a radiograph by a radiography apparatus using a photographic combination of a silver halide photographic light sensitive material interposed between intensifying screens, the photographic material comprising a support having a light sensitive silver halide emulsion layer on each of both sides of the support, wherein the radiography apparatus conducts making a radiograph under the condition that a distance between the focal point of an X-ray tube and the photographic material is 0.9 to 3.0 m, a distance between the focal point of the X-ray tube and an object is 0.5 to 2.7 m and a distance between the object and the photographic combination is 0.3 to 1.5 m;

(2) a silver halide photographic light sensitive material which is sandwiched between intensifying screens to form a photographic combination for use in a radiographic imaging system for making a radiograph by a radiography apparatus, wherein the radiography apparatus conducts making a radiograph under the condition that a distance between a focal point of an X-ray tube and the photographic material is 0.9 to 3.0 m, a distance between the focal point of the X-ray tube and an object is 0.5 to 2.7 m and a distance between the object and the photographic combination is 0.3 to 1.5 m;

the photographic material comprises a support having a light sensitive silver halide emulsion layer on each of both sides of the support, the photographic material exhibiting a crossover of not more than 15% and an average contrast of not less than 3.4 when the photographic combination is exposed to X-ray and subjected to processing (A), wherein the processing (A) is conducted using a roller transport type automatic processor and the following developer solution (D) and fixed solution (F) at a developing temperature of 35° C. for a developing time of 24 to 28 sec. and at a fixing temperature of 33° C. for a fixing time of 15 to 25 sec.:

| | |
|---|---|
| Water | 800 ml |
| Potassium hydroxide | 22 g |

-continued

| | |
|---|---|
| Potassium sulfite | 65 g |
| Hydroquinone | 27 g |
| Triethylene glycol | 20 g |
| 5-nitroindazole | 0.2 g |
| Acetic acid (56% aqueous solution) | 19 g |
| 1-Phenyl-3-pyrazolidone | 1.1 g |
| 5-Methylbenzotriazole | 0.05 g |
| Glutar aldehyde.sodium bisulfite adduct | 4.0 g |
| Potassium bromide | 4.0 g |

in which water is added to make 1 lit. and the pH is adjusted to 10.25 with an aqueous acetic solution; and

| Fixer solution F | |
|---|---|
| Water | 30 ml |
| Ammonium thiosulfate (70% weight/volume) | 200 ml |
| Sodium sulfite | 14 g |
| Gluconic acid | 7 g |
| Sodium acetate trihydrate | 25 g |
| Disodium ethylenediaminetetraacetate dihydrate | 0.1 g |
| Aluminum sulfate | 16 g |
| Sulfuric acid | 3 g |

in which water is added to make 1 lit. and the pH is adjusted to 4.55 with an aqueous acetic-acid solution or aqueous sodium hydroxide solution.

DETAILED DESCRIPTION OF THE INVENTION

To enhance detectability in radiographic imaging, besides contrast-increasing of the silver halide photographic material of the photographic combination, micro-calcification images can be detected at still smaller size levels by applying magnification radiography. In this method the same effect as an enhancement of sharpness can be achieved without deteriorating graininess and a magnifier is usually employed in viewing of the mammography.

Figure 1:
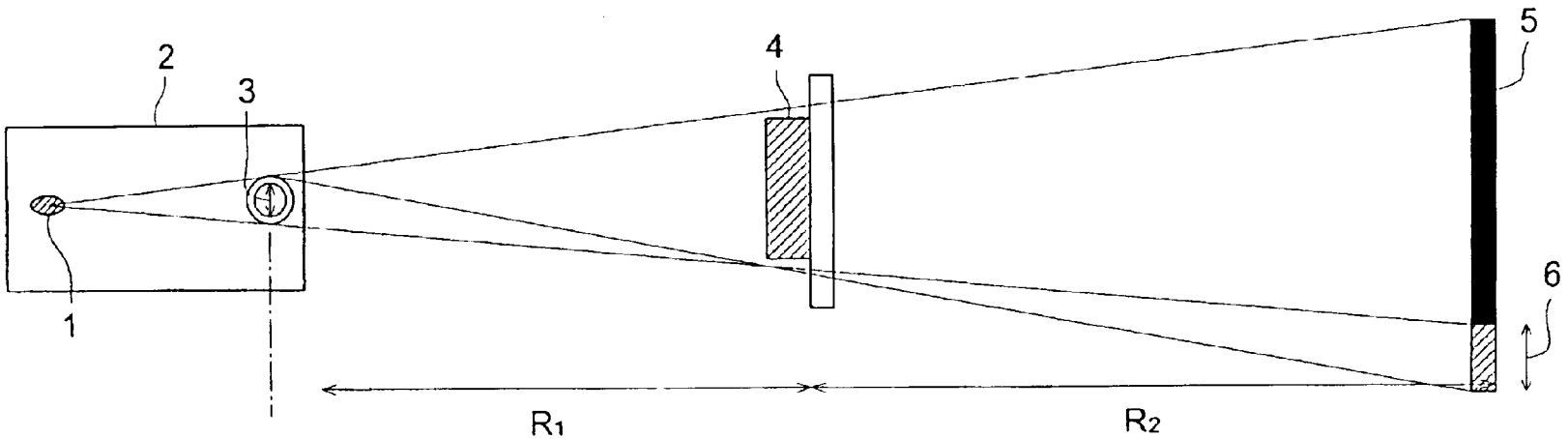
FIG. 1 shows a focus size of an X-ray tube and blurring.

However, magnification radiography results in blurring of images due to geometrical unsharpness. This blurring is unsharpness due to a so-called penumbra, depending on the focus size of the X-ray tube and the magnification factor, as shown in FIG. 1. In FIG. 1, "1" represents an apparent X-ray tube, "2" represents a real X-ray tube and "3" represents the real X-ray producing source. Since the X-ray source is not a point source, blurring, as designated by "6" occurs on the photographic combination (5) of a photographic material in combination with intensifying screen(s). In FIG. 1, "4" is a radiographic object, and $R_1$ and $R_2$ are the distance between the X-ray tube and the object, and the distance between the object and the photographic combination, respectively. This blurring can be overcome by the refraction contrast imaging technology in this invention. In cases when this imaging technology is applied to mammography, the distance between the X-ray tube and the photographic combination needs to be increased, so that a screen-film system exhibiting high image quality and high sensitivity is needed to overcome the foregoing problem (hereinafter, the film-screen system refers to a system for making a radiograph by means of X-rays produced from an X-ray source and a photographic combination of a photographic material in combination with intensifying screens). Thus, enhancement of detectability of micro-calcification without deteriorating detectability of tumors can be achieved by application of magnification radiography with a high-speed screen-film system, without deteriorating the image quality.

Accordingly, it is an object of this invention to provide a screen-film system for use in radiography to conduct magnification-radiography of enhanced sharpness, and a radiographic imaging method by the use of the same, as specifically described in detail below.

X-rays are electromagnetic waves, having properties of wave. When an X-ray beam penetrates objects differing in their refractive index, refraction occurs at the interface thereof.

Figure 2:
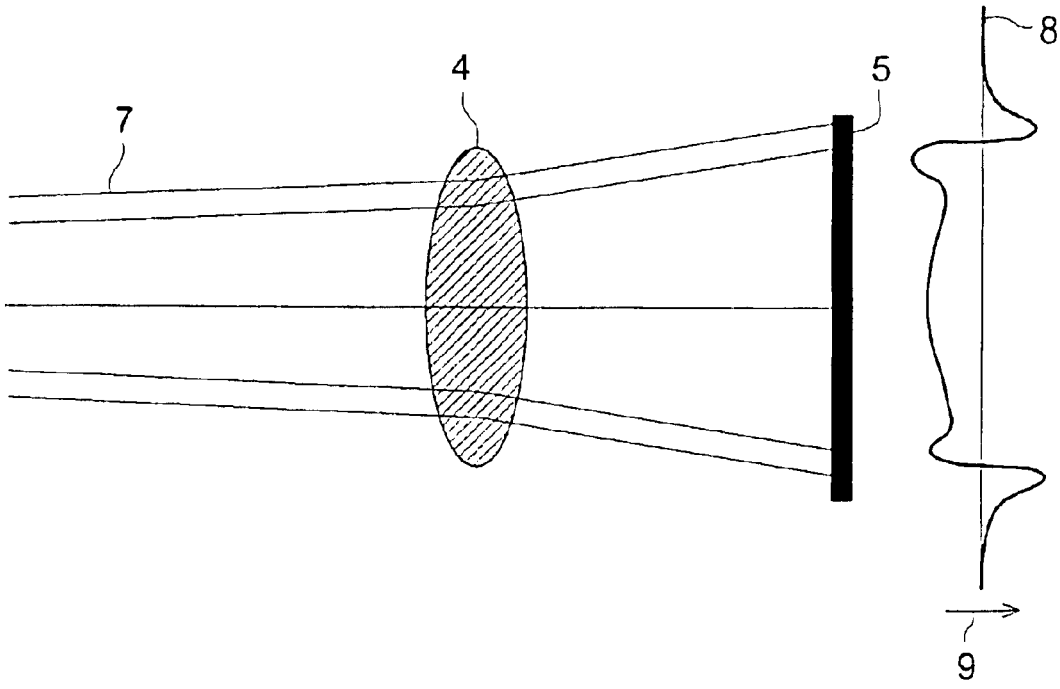
FIG. 2 shows X-ray intensity distribution on a photographic combination, caused by refraction at the interface of an object.

As is schematically shown in FIG. 2, in the X ray transmission image corresponding to the interface differing in refractive index, and projected on the X ray detector (which corresponds to photographic combination "5" comprised of a photographic material and an intensifying screen in FIG. 1), a portion in which the X-ray density is decreased by refraction of the X-ray and a portion in which the X-ray density is increased by overlapping of a refracted X-ray beam with a rectilinear X-ray beam are produced, resulting in an edge-enhanced image. Also in FIG. 2, "4" represents an object, "7" represents X-rays, "8" represents an intensity distribution of X-rays received by photographic combination (5) and "9" represents the direction of X-ray exposure. As shown therein, an edge effect results through refraction of X-rays at the interface of the object. Such a phenomenon is called a refraction contrast. Conventional X-ray images exhibit only an absorption contrast based on the difference in absorption and such a refraction contrast has so far not been fully employed.

In the invention, even when blurring of an image is caused by the penumbra in magnification radiography, such blurring can be overcome by applying the refraction contrast to cause edge enhancement, leading to a magnified X-ray image exhibiting superior sharpness.

In mammography, a silver halide photographic material having a light sensitive layer on one side of the support which is brought into contact with a radiographic intensifying screen, i.e., a screen-film system is employed in X-ray imaging, in which the intensifying screen is exposed to X-rays and emits visible light in response to the X-ray dose, after which the silver halide photographic material is exposed to the emitted light. Therefore, sensitivity of the photographic combination depends on the combination of the intensifying screen with the silver halide photographic material used therein. In conventional magnifying mammography, the distance between an X-ray tube and an object is 30 to 50 cm, and the distance between the object and the photographic combination as an X-ray detector is from 30 to 10 cm, therefore, the distance between the X-ray tube and the photographic combination is at most 60 to 70 cm. The exposure dose at this distance is 3 to 14 mR and the conventional screen-film for use in mammography is constituted so as to meet such exposure conditions.

As an X-ray tube of an X-ray source used in mammography usually employed is a molybdenum tube, the focus size of which is usually rather small, e.g., 100 $\mu$m. In this case, it was further proved that the distance between the X-ray source (or the focal point of an X-ray tube) and the object needed to be at least 50 cm and at most 270 cm to obtain satisfactory refraction contrast images. Furthermore, the distance between the object and the photographic combination (or screen-film system), needs to be at least 30 cm and at most 150 cm. Thus, the distance between the X-ray tube and the photographic combination needs to be at least 90 cm and at most 300 cm to result in a refraction contrast image employing a 100 $\mu$m molybdenum tube, so that the distance between the X-ray source and the photographic combination becomes greater than that of the conventional radiography apparatus and an increased X-ray dose is needed. However, an increase in X-ray dose is not suitable in terms of X-ray exposure and a screen-film system for making a radiograph at a lower X-ray dose is desired.

In this invention, it is preferred to provide a photographic combination of a silver halide photographic material in combination with intensifying screen(s) for use in mammography, exhibiting a sensitivity of 150 to 800, and preferably 200 to 500.

The speed of the photographic combination of a radiographic intensifying screen and a silver halide photographic material which is coated with light sensitive layers on both sides of the support is determined according to the following procedure. Using X-rays generated in a molybdenum target tube operated at 28 kVp of a three phase electric power source and transmitted through a 1 mm beryllium filter, a 0.03 mm molybdenum filter and 2 cm acryl filter, the photographic combination is subjected to exposure and the silver halide photographic material is subjected to photographic processing. Herein, the speed of the photographic combination is represented by a relative value of the reciprocal of an X-ray exposure amount necessary to give a density of 1.0 plus a fog density, based on the speed of silver halide photographic material for use in mammography (CM-H, available from Konica Corp.) in combination with intensifying screen (MD100, available from Konica Corp.) being 100.

The sensitivity of a radiographic intensifying screen can be measured in the following manner. An X-ray film for use in mammography, CM-H available from Konica Corp. is employed, which is combined with intensifying screen MD 100, available from Konica Corp. to form a photographic combination. A molybdenum target X-ray tube, a 1 mm thick beryllium filter, a 0.03 mm thick molybdenum filter and a 2 cm thick acryl filter were used, at a position of 60 cm apart from which the screen-film combination is placed and exposed to X-ray from the film side. The X-ray exposure amount is adjusted by varying the mAs value of the X-ray tube. After processing, the reciprocal of the X-ray exposure amount necessary to give a density of 1.0 plus a fog density is determined, and which is defined as the sensitivity of this combination of a silver halide photographic material in combination with an intensifying screen being 100. The relative sensitivity of an intensifying screen is determined similarly to the above, provided that screen MD-100 is replaced by the screen to be measured, which is combined with film CM-H.

In this invention, photographic materials are preferably processed according to processing (A). Thus, using a roller transport type automatic processor, the processing (A) is conducted at a developing temperature of 35° C. for a developing time of 24 to 28 sec. and-at-a fixing temperature of 33° C. for a fixing time of 15 to 25 sec. For example, processing is carried out at 33° C. over a period of 90 sec. with developer solution D and fixer solution F using automatic processor SRX-502, available from Konica Corp., in which the developing time is 25.5 sec., the fixing time is 15.9 sec., the washing time is 12.4 sec. and the squeezing and drying time is 25.2 sec. The developing time refers to the period of time of from the time when the top of a photographic material is immersed into a developer solution to the time when the top is immersed into a fixer solution, and the fixing time refers to the period of time of from the time when the top of the photographic material is immersed into the fixer solution to the time when the top is immersed into a washing water. The developer solution D and fixer solution F are as follow:

| Developer solution D | |
|---|---|
| Water | 800 ml |
| Potassium hydroxide | 22 g |
| Potassium sulfite | 65 g |
| Hydroquinone | 27 g |
| Triethylene glycol | 20 g |
| 5-nitroindazole | 0.2 g |
| Acetic acid (56% aqueous solution) | 19 g |
| 1-Phenyl-3-pyrazolidone | 1.1 g |
| 5-Methylbenzotriazole | 0.05 g |
| Glutar aldehyde.sodium busulfite adduct | 4.0 g |
| Potassium bromide | 4.0 g |

Water is added to make 1 lit. and the pH is adjusted to 10.25 with aqueous acetic solution.

| Fixer solution F | |
|---|---|
| Water | 30 ml |
| Ammonium thiosulfate (70% weight/volume) | 200 ml |
| Sodium sulfite | 14 g |
| Gluconic acid | 7 g |
| Sodium acetate trihydrate | 25 g |
| Disodium ethylenediaminetetraacetate dihydrate | 0.1 g |
| Aluminum sulfate | 16 g |
| Sulfuric acid | 3 g |

Water is added to make 1 lit. and the pH is adjusted to 4.55 with an aqueous acetic acid solution or an aqueous sodium hydroxide solution.

In this invention, a screen-film system for use in mammography, exhibiting higher sensitivity is preferable. However, the use of an intensifying screen exhibiting higher sensitivity (or luminance) for enhancing the sensitivity of the system deteriorates sharpness, leading to a lowering of detectability of the fine structure of microcalcination. It is therefore preferable to enhance sensitivity of the silver halide photographic material. To enhance the sensitivity, it is necessary to increase the silver halide grain size. However, this leads to undesired problems that an increase of the grain size results in a lowering of covering power, i.e., unless the coating amount of silver halide grains per unit area is increased, the maximum density or contrast is lowered, leading to deteriorated graininess.

In the silver halide photographic material used in this invention, although an increase of the coating amount of a silver halide emulsion is needed to compensate for the reduced maximum density due to reduced covering power caused by an increase of the silver halide grain size, the silver halide emulsion is coated on both sides of the support so that the silver coating amount on one side of the support is decreased, promoting the processing reaction or reducing drying load after washing. Further, processability equivalent to conventional one can be maintained and a marked enhancement of sensitivity can be achieved.

In conventional mammography systems, in which the distance between an X-ray source (i.e., focus of an X-ray tube) and a screen-film (or a photographic combination) is within the range of 60 to 70 cm, there has been such a problem that X-rays are radially emitted from the X-ray source so that when a photographic material comprising a support having on both sides thereof, emulsion layers are exposed, displacement occurs between images of the both sides, at the circumferential portions, leading to a lowering of sharpness. In the radiography system of this invention, however, the distance between the X-ray source and the screen-film is increased more than that of the conventional radiography system, so that X-rays emitted from the X-ray source become to being more parallel than being radial (in other words, from diffuse radiation to specular radiation), reducing displacement between images on both sides to reduce a lowering of sharpness. Further, a lowering of sharpness can be prevented by decreasing crossover light to levels of not more than 15%, preferably not more than 10%, and more preferably not more than 5%. The support thickness of less than 140 $\mu$m reduces deterioration in sharpness.

In silver halide photographic material comprising a transparent support having emulsion layers on both sides of the support, crossover exposure occurs when light emitted by one screen passes through the adjacent emulsion layer and the support to imagewise expose the emulsion layer on the opposite side of the support. Thus, crossover light is light which has crossed over to the opposed layer. Percent crossover [denoted as crossover (%)] can be determined based on the method described in T. I. Abbott et al. U.S. Pat. No. 4,425,425. Thus, in a silver halide photographic material having two substantially identical light sensitive layers on opposite sides of a transparent support, an intensifying screen, the photographic material and black opaque paper are arranged in this order from an X-ray source, which are packed in a cassette for use in radiography and subjected to stepwise exposure to X-rays. After completion of processing, an image of the light sensitive layer in contact with the screen is separated from the image of the light sensitive layer on the opposite side and characteristic curves for images of the two light sensitive layers are respectively obtained. The difference in sensitivity between the linear portions of the characteristic curves is denoted as Alog E, and percent crossover is defined as below:

$$\text{Crossover } (\%)=100/[\text{antilog}(\Delta\log E)+1].$$

In this invention, the density is a density measured using densitometer PDA-65, available from Konica corp. and selecting a visual filter.

Sensitivity of the silver halide photographic material which is represented in terms of lux-sec and contrast thereof can be determined according to the method described in JP-A No. 10-62881, in which processing conditions are the same as in the afore-mentioned determination of sensitivity of intensifying screens.

The radiographic imaging system according to this invention is effective in obtaining images exhibiting enhanced sharpness under the condition that the X-ray tube voltage at the time of radiographing is not less than 15 kVp and not more than 150 kVp, specifically in mammography employing a characteristic X-ray or at the time of making a radiograph with low energy X-rays of not more than 60 kVp.

Sites to be photographed with low energy X-ray include a site required for enhanced sharpness, such as a mamma or quarter bones, in which photographic materials at least 2.5 of an average contrast connecting the density of 0.25 plus a fog employed and the density of 2.00 plus a fog density.

Specifically in mammography employing characteristic X-rays of not more than 50 kVp or non-destructive testing, the imaging method of this invention achieved particularly enhanced sharpness. In such uses, there have been employed a photographic materials having a light sensitive emulsion layer only on one side of the support and exhibiting a relatively high average contrast of 3.0 or more, which is a slope of a straight line connecting the density of 0.25 plus a fog employed and the density of 2.00 plus a fog density on the characteristic curve of the photographic material. The silver halide photographic material of this invention which has been processed according to the afore-mentioned processing exhibits an average contrast of not less than 3.4, preferably not less than 3.7 and more preferably not less than 3.7 and less than 4.5. The average contrast of not less than 4.5 results in deterioration in resistance to roller marks and deteriorated process evenness. Herein, the average contrast is also defined as a slope of a straight line that connects two points corresponding to the density of 0.25 plus a fog employed and the density of 2.00 plus a fog density on the characteristic curve of the photographic material.

In this invention, sensitivity of the silver halide photographic material of this invention can be determined according to the method described in JP-A No. 10-62881. Thus, the sensitivity can be determined by exposing the photographic material to a monochromatic light emitted by an intensifying screen, which has its main emission peak at the same wavelength as that of the maximum sensitivity of the photographic material and exhibits a half-wave value of the main emission of 20±5 nm. In the case of a photographic material being green-sensitive, monochromatic light of 545 nm is used. A filter system in combination with an interference filter is employed to obtain the monochromatic light of 545 nm. According to this method, though depending of the combination with an interference filter, a monochromatic light having the necessary amount and a half band width of 20+5 nm can be readily obtained. Examples of an exposure light source include a combination of a tungsten light source (color temperature of 2856° K) and a transmission filter exhibiting a transmission peak at 545 nm and a half band width of 20 nm. Using this monochromatic light as a light source, which has been measured with a corrected illumination photometer with respect to illuminance, photographic material is exposed through an optical wedge with a neutral filter at a distance of 1 m for 1 sec. The exposed photographic material is processed according to the afore-mentioned processing A and subjected to densitometry to determine the exposure amount necessary to give a density of 1.0 plus a fog density to determine sensitivity in terms of lux·sec.

In this invention, the thus obtained sensitivity is preferably not more than 0.010 lux·sec., more preferably not more than 0.007 lux·sec., and still more preferably within the range of 0.002 to 0.007 lux·sec. Sensitivity of less than 0.002 lux·sec. results in deterioration in graininess. In this case, silver coverage is increased to maintain the maximum density, unfortunately leading to a lowering of rapid accessibility or processability at a low replenishing rate.

Transparent supports used in this invention preferably have an absorption maximum at the wavelengths of 580 to 700 nm and blue-tinted supports exhibiting a visual density of 0.01 to 0.025 are preferred. In cases where the support thickness is not less than 140 $\mu$m, the crossover light percentage needs to be not more than 15%, preferably not more than 10%, and more preferably not more than 5%. The support thickness is preferably 140 to 210 μm, and more preferably 160 to 190 μm. Material of the support is not specifically limited but is preferably polyethylene terephthalate and polyethylene naphthalate. In the case of a 140 μm or more thick support, polyethylene terephthalate is preferred. In the case of less than 140 μm, a support exhibiting high rigidity, such as polyethylene naphthalate is preferred. The thickness, depending on the rigidity of the support material is preferably 80 to 140 μm, and more preferably 90 to 130 μm.

Figure 3:
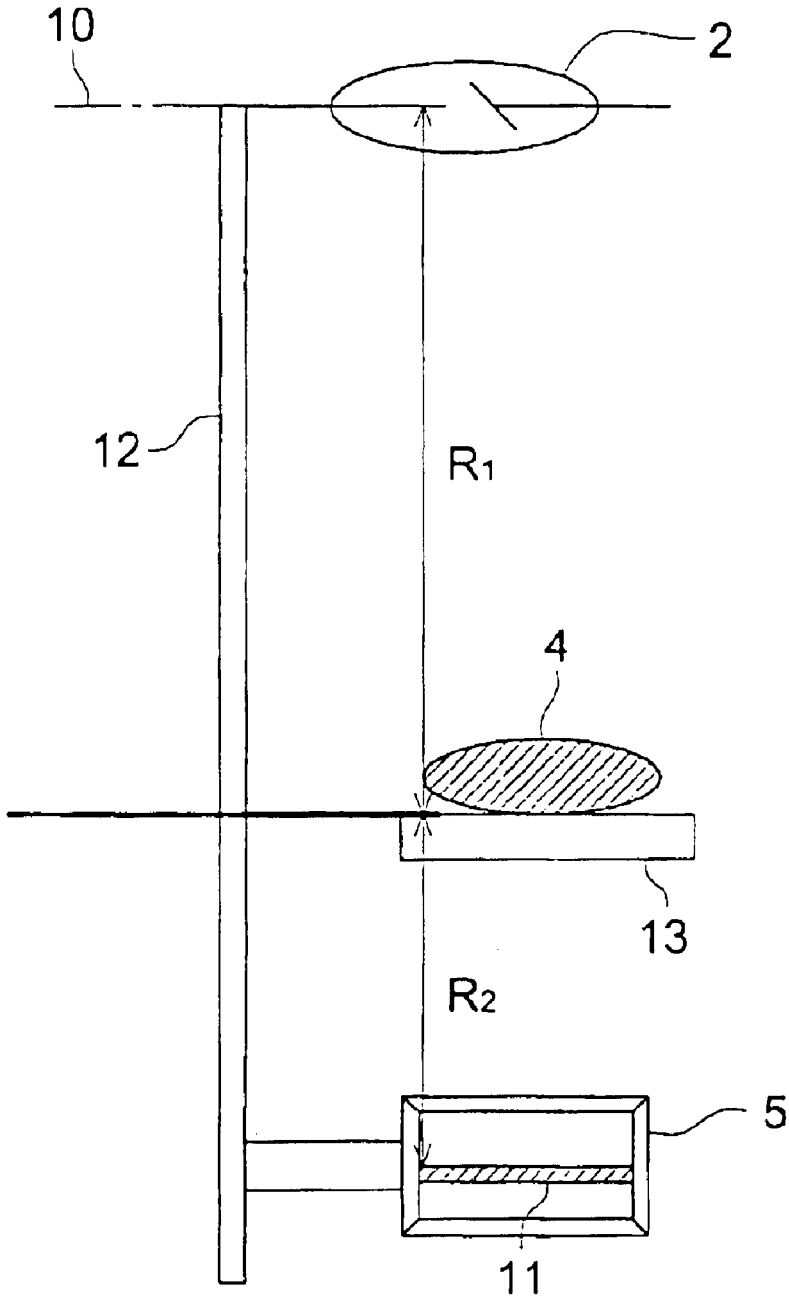
FIGS. 3 and 4 illustrates examples of radiographic imaging systems of the invention.
Figure 4:
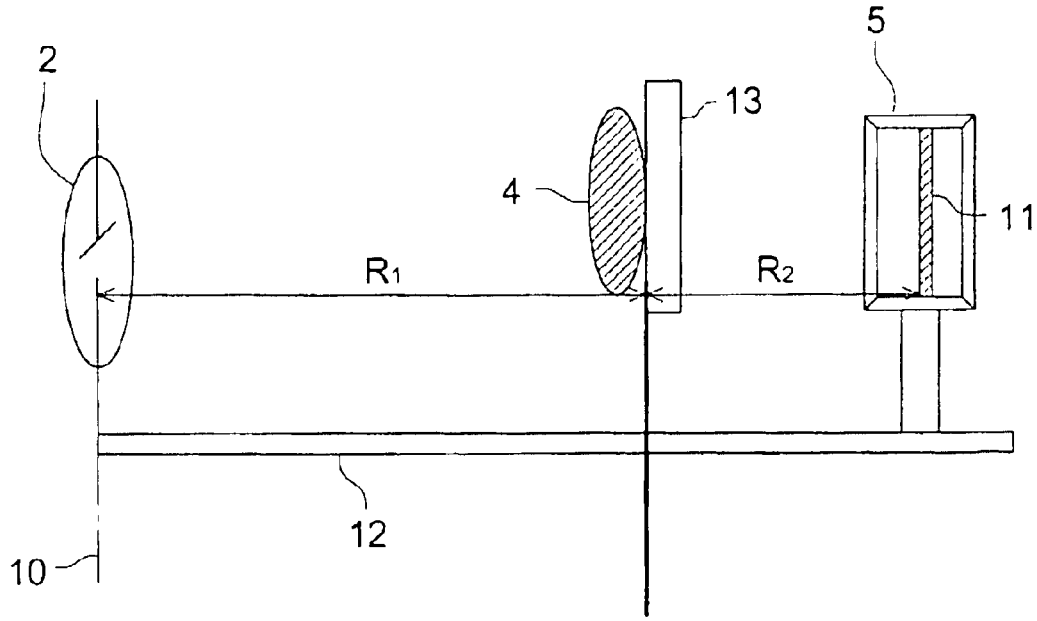

In the radiographic imaging system of this invention, the distance between the X-ray tube bulb and the photographic material in combination with intensifying screens is rather large and X-rays are attenuated, sensitivity being higher than that of a silver halide photographic material in combination with intensifying screens used in conventional radiography apparatuses is preferable. In the radiographic imaging system of this invention, however, the distance between a radiographic object and the intensifying screen is also large and effects due to scattered X-rays is so small even without using a grid, so that the X-ray dose can be reduced by removing the grid. In FIGS. 3 and 4, longitudinal type and transverse type radiographic imaging systems are schematically shown, wherein "2" represents a Coolidge X-ray tube; $R_1$ represents the distance between focal position (10) of the X-ray tube and the object (4) on a supporting tool and the object (4) is arranged so as to vary the distance ($R_1$) by moving it on distance-marked support (12); photographic material (11) of photographic combination (5) which is comprised of the photographic material and an intensifying screen is arranged at a distance $R_2$ apart from the object (4).

Intensifying screens usable in this invention are not specifically limited but preferably contain a phosphor of 60 to 120 mg/m$^2$ and exhibit contrast transfer function (also denoted as a CTF value of 0.35 to 1.00 at a spatial frequency of 5 line/mm. The contrast transfer function refers to a physical value representing a sharpness of an image obtained in the combination used therein. The maximum value is 1.0, the minimum is 0.0, of which the larger value represents the superior sharpness. The determination thereof is made as follows. A rectangular lead or tin chart is allowed to be in close contact with the photographic combination and exposed to X-rays. The rectangular images obtained after processing are subjected to densitometry using a microdensitometer and thereby a contrast transfer function (CTF) is obtained for each spatial frequency. In this invention was used a rectangular tin chart for use in MTF measurement, Type 9, available from Kasei Optonics Co., Ltd.

Sharpness of the photographic combination greatly depends of the contrast of the silver halide photographic material and the sharpness of the intensifying screen used therein. An intensifying screen exhibiting superior sharpness comprises a support having thereon a phosphor layer an a protective layer, in which the mean phosphor particle size is preferably 2 to 5 μm, the phosphor filling ratio is preferably 60 to 80% and the binder content is preferably 0.1 to 5% by weight, based on the phosphor layer. Examples of preferred phosphors used in the radiographic intensifying screen include the following: terbium activated rare earth sulfide phosphor (e.g., $Y_2O_2S$:Tb, $Gd_2O_2S$:Tb, $La_2O_2S$:Tb, $(Y.Gd)_2O_2S$:Tb, $(Y.Gd)_2O_2S$:Tb. Tm, etc.); terbium activated rare earth phosphate phosphor (e.g.,$YPO_4$:Tb, $GdPO_4$:Tb, $LaPO_4$:Tb etc.); terbium activated rare earth oxyhalide phosphor (e.g., LaOBr: Tb, LaOBr:Tb. Tm, LaOCl:Tb, LaOCl:Tb.Tm, LaOCl:Tb.Tm, LaOBr:Tb, GdOBr:Tb, GdOCl:Tb, etc.); thulium—activated rare earth oxyhalide phosphor (e.g., LaOBr:Tm, LaOCl:Tm); barium sulfate phosphor (e.g., $BaSO_4$:Pb, $BaSO_4$:$Eu^{2+}$, $(Ba.Sr)SO_4$:$Eu^{2+}$); bivalent europium activated alkali earth metal phosphate phosphor [e.g., $(Ba_2PO_4)_2$:$Eu^{2+}$, $(Ba_2PO_4)_2$:$Eu^{2+}$, etc.]; bivalent europium activated alkali earth metal fluorohalide phosphor [e.g., BaFCl:$Eu^{2+}$, BaFBr:$Eu^{2+}$, BaFCl:$Eu^{2+}$.Tb, BaFBr:$Eu^{2+}$.Tb, $BaF_2$BaClKCl:$Eu^{2+}$, (Ba Mg)$F_2$BaClKCl:$E^{2+}$ etc.]; iodide phosphor (e.g., CsI:Na, CsI:Tl, NaI, KI:Tl); sulfide phosphor [ZnS:Ag, (Zn Cd)S:Ag, (Zn Cd)S:Cu, (Zn Cd)S:Cu.Al]; hafnium phosphate phosphor (e.g., $HfP_2O_7$:Cu); tantalate phosphor (e.g., $YTaO_4$, $YTaO_4$:Tm, $YTaO_4$:Nb, [Y Sr]$TaO_{4-x}$:Nb, $LuTaO_4$, $LuTaO_4$:Nb, (Lu Sr)$TaO_{4-x}$:Nb, $GdTaO_4$:Tm, $Gd_2O_3TaO_4$:Tm, $Gd_2O_3Ta_2O_5B_2O_3$:Tb). However, phosphors usable in the invention are not to these compounds. Any phosphor capable of emitting visible or near-ultra violet light upon exposure to radiation, may be usable.

Examples of binders used in the intensifying screen include polyurethane, vinyl chloride copolymer, vinyl chloride-vinyl acetate copolymer, vinyl chloride-vinilidene chloride copolymer, vinyl chloride-acrylonitrile copolymer, butadiene-acrylonitrile copolymer, polyamide, polyvinyl butyral, cellulose derivative (e.g., nitrocellulose), styrene-butadiene copolymer, a variety of types of synthetic rubber resin, phenol resin, epoxy resin, urea resin, melamine resin, phenoxy resin, silicone resin, acryl resin and urea-formamide resin. Among these, polyurethane-polyester, vinyl chloride type copolymer, polyvinyl butyral and nitrocellulose are preferably used. The average molecular weight of the binder is preferably 5,000 to 200,000. The binder preferably contains a resin containing a hydrophilic polar group. In this case, the hydrophilic polar group improves dispersion of the phosphor particles, through its adsorption to the surface of the particles, leading to prevention of coagulation of the phosphor particles and enhancement of coating stability, sharpness and graininess. The resin containing a hydrophilic polar group is one containing a hydrophilic polar group selected from the group consisting of —$SO_3M$, —$OSO_3M$, —COOM,—$PO(OM')_2$, and —OPO $(OM')_2$ (i.e., negative functional group), in which M is hydrogen atom or an alkali metal atom such as Li, K, Na.

The phosphor layer thickness of intensifying screens used in this invention is preferably 20 to 150 μm, and more preferably 50 to 120 μm. To prevent a lowering of sharpness caused by diffused light, the layer may be dyes using (red or yellow), dyes having an absorption within the emission wavelengths of the phosphor.

The silver halide photographic material used in this invention preferably is one which has a silver halide emulsion layer on a subbed, blue-tinted polyethylene terephthalate or polyethylene naphthalate support and a gelatin layer as a backing layer on the other side of the support. The backing layer is preferred in terms of anti-curling. It is preferred to subject to a matting treatment to prevent blocking of films. It is a preferred embodiment to contain an antistatic agent or anti-halation agent. In one preferred embodiment, this photographic film is in a sheet form and rounded at its corners to prevent an injury, and a notch is put to recognize the emulsion side. In the enlarging mammography, a photographic film of a size 8×10 inches or more is preferably employed to obtain an entire image of a mamma.

Halide composition of silver halide grains contained in the photographic material used in this invention is not specifically limited, including AgBr, AgCl, AgClBr, AgClBrI and AgBrI. Of these, AgBrI grains containing 2 mol % or less iodide are preferred. Chloride of 50 mol % or less may be contained. The average iodide content in the outer region of the grain accounting for 50% of the grain volume is preferably less than that of the inner region of the grain accounting for 50% of the grain volume. The shape of silver halide grains may be cubic, tetradecahedral, octahedral, tabular or a mixture thereof.

Tabular silver halide grains are preferably employed to enhance sensitivity of the silver halide photographic material used in this invention. The tabular grains, which are described in U.S. Pat. Nos. 4,439,520, 4,425,425 and 4,414, 304, can be readily obtained. The tabular grains may be epitaxially grown with different halide compositions at a specific site on the grain surface or may be shelled. Further, to control sensitivity specks, dislocation lines may be introduced onto the surface or into the interior of the tabular grain.

At least 50% of the projected area of total grains contained in a silver halide emulsion layer is preferably accounted for by tabular grains exhibiting an aspect ratio of 2 or more. An increase of the proportion of such tabular grains to 60 to 70% and to 80% leads in further preferred results. The aspect ratio refers to the ratio of a diameter of a circle equivalent to the grain projected area (so-called circular equivalent diameter) to a distance between two parallel tabular planes (i.e., thickness). The aspect ratio is preferably not less than 2 and less than 20, and more preferably not less than 3 and less than 16. The thickness of tabular grains is preferably not more than 0.5 $\mu$m, and more preferably not more than 0.3 $\mu$m. A monodisperse emulsion exhibiting a coefficient of variation of grain size distribution of not more than 30%, and preferably not more than 20%, which is defined as a standard deviation of circular equivalent diameter (S) divided by an average diameter (D) times 100%, i.e., S/D×100, is preferred. Tabualr grains may be blended with non-tabular regular crystal grains having different crystal havit. Two or more kinds of tabular grains which are different in grain size may be blended.

To control the growth rate during the formation of tabular grains, silver halide solvents may be employed, including ammonia, thioether compounds and thione compounds. Metal salts such as zinc, lead, thallium, iridium, rhodium and osmium may be incorporated during the stage of physical ripening or chemical ripening. Sensitizing dyes may be incorporated during the stage of forming silver halide grains. Iridium is incorporated preferably in an amount of $1\times10^{-7}$ to $1\times10^{-5}$ mol per mol of silver halide and the content in the surface region of the grain accounting for 50% or less of the grain volume is preferably more than that of other potions within the grain. Rhodium is incorporated preferably in an amount of $1\times10^{-9}$ to $1\times10^{-7}$ mol per mol of silver halide and the content in the outermost surface region of the grain accounting for 3%, of the grain volume is preferably less than that of other portions.

Chemical sensitization is employed, including sulfur sensitization, selenium sensitization, tellurium sensitization, reduction sensitization, noble metal sensitization and a combination thereof. Sulfur sensitizers usble in this invention are described in U.S. Pat. Nos. 1,574,944, 2,410,689, 2,728,668, 3,501,313, 3,656,955; West German Patent (OLS) No. 1,422,869; JP-A No. 56-24937 and 55-45016. Various kinds of selenium compounds are used as a selenium sensitizer, as described in U.S. Pat. No. 1,574,944, 1,602,592, 1,623,499; JP-A Nos. 60-150046, 4-25832, 4-109240 and 4-147250. Of these selenium sensitizers, seleno-ureas, seleno-amides and seleno-ketones are preferred. Techniques for using selenium sensitizers are exemplarily described in H. E. Spencer, J. Photographic Science 31, 158–169 (1983). The amount of a selenium sensitizer to be used, depending of selenium compound, silver halide grain, chemical ripening conditions, is generally $10^{-8}$ to $10^{-4}$ mol per mol of silver halide. The selenium sensitizer may be incorporated through solution in water or organic solvents such as methanol, ethanol or ethyl acetate, or in the form of a previously mixed gelatin solution. Alternatively, the method described in JP-A No. 4-140739 is also applicable, in which the sensitizer is incorporated in the form of a dispersion emulsified with an organic solvent-soluble polymeric compound. Chemical ripening with a selenium sensitizer is conducted preferably at a temperature of 40 to 90° C.) and more preferably 45 to 80° C.), a pH of 4 to 9, and a pAg of 6 to 9.5. Tellurium sensitizers and their chemical ripening are described in U.S. Pat. Nos. 1,623,499, 3,320,069, 3,772,031, 3,531,289, 3,655,394; British patent No. 235,211, 1,121,496, 1,295,4621, 396,696; Canadian Patent No. 800,958; JP-A Nos. 4-204640, and 4-33304. Tellurium sensitizers are used similarly to selenium sensitizers.

Reduction sensitization is preferably applied in combination. The reduction sensitization is conducted preferably during grain growth. Examples thereof include a method in which the reduction sensitization is conducted concurrently with grain growth and a method in which grain growth is interrupted, reduction sensitization is conducted then reduction-sensitized grains are further grown.

Examples of gold sensitizers include chloroauric acid, gold thiosulfate, gold thiocyanate, and gold complexes of various compounds such as thioureas and rhodanines. The amount of the sulfur sensitizer, selenium sensitizer, tellurium sensitizer, reduction sensitizer or gold sensitizer to be used, depending of silver halide, the kind of the compound to be used and ripening conditions, is preferably $1\times10^{-9}$ to $1\times10^{-4}$, and more preferably $1\times10^{-8}$ to $1\times10^{-5}$ mol per mol of silver halide. The sulfur sensitizer, selenium sensitizer, tellurium sensitizer, reduction sensitizer or gold sensitizer may be incorporated through solution in water or organic solvents such as methanol, ethanol or ethyl acetate, or in the form of a dispersion emulsified using a medium such as a gelatin solution.

Sensitizing dyes used in this invention may be incorporated at any time during or after the formation of silver halide grains and before coating, and preferably before completion of desalting. The pH of the reaction solution (in the reaction vessel) to be added with a sensitizing dye is preferably 4 to 10, and more preferably 6 to 9. The pAg of the reaction solution is preferably 5 to 11. Various-types of spectral sensitizing dyes can be employed. Cyanine dyes, for example, are preferably employed, in which exemplified compounds S-1 through S-124 represented by general formulas (I) to (III) described in JP-A 1-100533 are preferred. Sensitizing dyes may be incorporated alone or in combination. Two or more dyes may be mixed and added, or added separately at a time different each from the other. The amount thereof is preferably 1 to 1000 mg, and more preferably 5 to 500 mg per mol of silver halide. Prior to the addition of a sensitizing dye, potassium iodide may be added. Sensitizing dyes may be added directly added to the emulsion. Alternatively, the dyes may be added through solution in an appropriate solvent such as water methanol, ethanol, methyl cellosolve, acetone, pyridine or a mixture thereof. Ultrasonic dispersion may be employed. An aqueous insoluble sensitizing dye may be incorporated in the form of a fine solid particle dispersion which has been dispersed by means of a high-speed impeller.

In silver halide photographic materials used in this invention, the coating amount of hydrophilic colloid is preferably 1.0 to 4.0 g/m$^2$, the silver coverage is preferably 0.5 to 3.5 g/m$^2$, and the thickness of a layer swollen in water for 10 min. is larger by 2 tomes or more than that of its dry layer.

Matting agents usable in this invention, for example, fine particles of polymethyl methacrylate homopolymer, copolymer of methylmethacrylate and methacrylic acid, organic compounds such as starch, and inorganic compound particles such as silica, titanium dioxide, strontium sulfate, and barium sulfate. The particle size is preferably 0.6 to 10 $\mu$m, and more preferably 1 to 5 $\mu$m.

Lubricants may be incorporated into the surface layer of the photographic material, including silicone compounds described in U.S. Pat. Nos. 3,489,576 and 4,047,958; colloidal silica described in JP-B No. 56-23139) herein, the term, JP-B means published Japanese Patent), paraffin wax, higher fatty acid esters, and starch derivatives. Polyols such as trimethylol propane, pentane-diol, butane-diol, ethylene glycol, and glycerin may be incorporated, as a plasticizer, into any component layer of the photographic material.

Polymer latexes may be incorporated for the purpose of enhancing pressure resistance. Examples of polymers include alkyl acrylate homopolymer, copolymer of alkyl acrylate and acrylic acid or styrene, styrene-butadiene copolymer, and polymer or copolymer comprised of a monomer containing an active methylene group, an aqueous solubility-promoting group or group capable of cross-linking with gelatin. Specifically, to enhance miscibility with gelatin as a binder, copolymers mainly comprised of hydrophobic monomers such as alkyl acrylate or styrene and further comprised of a monomer containing an aqueous solubility promoting group are preferably employed. Examples of the monomer containing an aqueous solubility promoting group include acrylic acid, methacrylic acid, maleic acid, 2-acrylamido-2-methylpropane-sulfonic acid and styrene-sulfonic acid. Examples of the monomer containing a group capable of cross-linking with gelatin include glucidyl acrylate, glycidyl methacrylate and N-methylol acrylamide.

Further, various additives may be incorporated into photographic materials used in this invention. Examples of such additives are described in Research Disclosure (also denoted as RD) No. 17643 (December, 1978), ibid No. 18716 (November, 1979) and ibid No. 308119 (December, 1989).

Photographic materials used in this invention are processed by an automatic processor including steps of developing, fixing, washing and drying. The process time of developing to drying, that is, a period from the time a top of a photographic material is immersed into a developer to the time, through the steps of developing, fixing, washing and drying, to the time the top comes out from a drying zone is preferably 15 to 90 sec.

In this invention, a developing time is 6 to 30 sec, (more preferably 6to 20 sec.), and a developing temperature is 25 to 50° C. (preferably, 30 to 40° C.); a fixing time and temperature are preferably 6 to 20 sec. and 20 to 50° C. (and more preferably, 6 to 15 sec. and 30 to 40° C.). Drying is conventionally carried out at 35 to 100° C. and preferably by impinging hot air of 40 to 80° C. There may be provided a drying zone with a far-infrared ray heating means in a processor.

A processor provided with mechanism of supplying water or an acidic rinsing solution having no fixing ability to a photographic material, as disclosed in JP-A No. 3-264953, can be employed. There may be built in a processor an apparatus in which a developer or fixer can be prepared.

EXAMPLES

The present invention will be further described based on examples but are by no means limited to these.

Example 1

Preparation of Coating Solution of Monodisperse Tetradecahedral Grain Emulsion

Monodisperse core/shell type emulsion E2 of an average grain size of 0.45 $\mu$m was prepared in accordance with Example 1 of JP-A No. 9-146199 (preparation of emulsion Em-1). Similarly, monodisperse core/shell type emulsion E1 of an average grain size of 0.39 $\mu$m and emulsion E3 of an average grain size of 0.52 $\mu$m were respectively prepared, provided that in emulsion E1, the mixing time of solutions C2 and E2 was shortened, and in emulsion E3, amounts of solutions A1 and B1 were increased and the mixing time was prolonged. Coefficients of variation of grain size distribution of emulsions E1, E2 and E3 were 17%, 16% and 15%, respectively.

Thereafter, emulsions E1, E2 and E3 were subjected to chemical sensitization and spectral sensitization by adding chemical sensitizers and sensitizing dyes in a manner similar to Example 2 of JP-A No. 9-146199, except that fine silver iodide grains were not added. Additives were further added to the emulsions similarly to JP-A No. 9-146199 to obtain light sensitive silver halide emulsion coating solutions.

Preparation of Tabular Grain Emulsion Coating Solution

Tabular silver halide grain emulsion E4, exhibiting an average circular equivalent diameter of 1.04 $\mu$m and average aspect ratio of 4.3 was prepared in accordance with Example 1 of JP-A No. 9-146199 (preparation of emulsion Em-5). Similarly, tabular silver halide grain emulsion E5 was prepared, exhibiting an average circular equivalent diameter of 1.33 $\mu$m and average aspect ratio of 5.5. Thereafter, emulsions E4 and E5 were subjected to chemical sensitization and spectral sensitization and additives were further added to the emulsions similarly to JP-A No. 9-146199 to obtain light sensitive silver halide emulsion coating solutions.

Protective Layer Coating Solution

A coating solution of a protective layer was prepared similarly to the protective layer coating solution described in example 2 of JP-A 9-146199.

Dye Layer Coating Solution

A dye layer coating solution was prepared in accordance with Example 1 (1st layer, dye layer) of JP-A 10-213880, provided that amounts of a filter dye were adjusted so as to give a crossover shown in Table 1.

On both sides of a blue-tinted, subbed 175 $\mu$m thick polyethylene terephthalate (PET) film support exhibiting a density of 0.18, the dye layer coating solution, emulsion coating solution and protective layer coating solution were simultaneously coated to obtain photographic material samples (1) through (7), in which the silver coverage of the emulsion layer was adjusted as shown in Table 1 and gelatin coating amounts of the emulsion layer and protective layer were also adjusted to 2.0 g/m$^2$ and 1.0 g/m$^2$, respectively.

Samples (8) through (10) were similarly prepared, provided that the dye layer was not provided and the PET support was replaced by polyethylene naphthalate (PEN) film support having an identical thickness.

Sensitivity of Film

Samples were each exposed to monochromatic light of 545 nm, having a half band width of 20 nm to determine sensitivity. The exposed samples were processed with developer solution D and fixer solution F at 33° C. for 90 sec., using automatic processor SRX-502. The sensitivity was represented in terms of lux·sec. and results are shown in Table 1.

Determination of Average Contrast, Dmax and Crossover (%)

Using a photographic combination of each of the samples sandwiched between two intensifying screens MD-100, available from Konica Corp., the average contrast and maximum density (Dmax) was determined for each of the photographic material samples. Rotary anode X-ray tube Rotanode DRX-B1146B-Mo (available from Toshiba Electric Co. Ltd.) was employed. This X-ray tube (molybdenum target tube) was operated at 28 kVp of a three phase power source, and each of the films was exposed to X-ray transmitted through 1 mm thick beryllium, 0.03 mm thick molybdenum and 2 cm thick acryl filters. A characteristic curve for each sample was prepared by varying X-ray exposure, and by varying the distance between the X-ray tube and the photographic material, being the so-called distance method. The contrast was determined from the slope of a line connecting the density of a fog density plus 0.25 on the characteristic curve and the density of the fog density plus 2.0. From the characteristic curve, the maximum density (Dmax) was also determined. Processing was conducted with developer solution (D) at 35° C. and fixer solution (F) at 33° C. using automatic processor SRX-502, available from Konica Corp. For comparison, a photographic combination of CM-H (single-sided coated photographic material, available from Konica Corp.) in combination with an intensifying screen laminated onto the emulsion side was also used (single-back radiograph).

Crossover (%) was determined according to the method of Abotte et al. described in U.S. Pat. No. 4,425,425.

TABLE 1

| Sample No. | Emulsion | Silver Coverage (both side) ($g/m^2$) | Dmax | Sensitivity (lux · sec) | Average Contrast | Crossover | Support Thickness | Support Material |
|---|---|---|---|---|---|---|---|---|
| (1) | E1 | 4.2 | 4.25 | 0.0183 | 4.32 | 12% | 175 μm | PET |
| (2) | E2 | 4.2 | 3.68 | 0.0138 | 4.14 | 14% | 175 μm | PET |
| (3) | E3 | 4.2 | 3.18 | 0.0100 | 3.97 | 17% | 175 μm | PET |
| (4) | E4 | 4.2 | 3.64 | 0.0075 | 3.85 | 10% | 175 μm | PET |
| (5) | E5 | 4.2 | 3.24 | 0.0050 | 3.45 | 15% | 175 μm | PET |
| (6) | E4 | 4.2 | 3.64 | 0.0075 | 3.85 | 4% | 175 μm | PET |
| (7) | E4 | 4.6 | 3.99 | 0.0075 | 3.85 | 8% | 175 μm | PET |
| (8) | E4 | 4.2 | 3.64 | 0.0075 | 3.85 | 10% | 175 μm | PEN |
| (9) | E4 | 4.2 | 3.64 | 0.0075 | 3.85 | 10% | 125 μm | PEN |
| (10) | E4 | 4.2 | 3.64 | 0.0075 | 3.85 | 10% | 85 μm | PEN |
| | CM-H | 3.3 | 4.02 | 0.0120 | 3.31 | — | 175 μm | PET |

Preparation of Intensifying Screen

Intensifying screens were prepared in accordance with Example 2 of JP-A 10-171049, as shown in Table 2.

TABLE 2

| Screen | Sub-layer | Phosphor Layer Thickness (μm) | Carbon Black (%)*2 | Phosphor ($g/m^2$) | Screen Sensitivity | CTF (5 line/mm) |
|---|---|---|---|---|---|---|
| A | C.B.*1 | 171 | 0 | 82 | 224 | 0.33 |
| B | C.B. | 154 | 0 | 72 | 218 | 0.36 |
| C | C.B. | 130 | 0 | 62 | 210 | 0.38 |
| D | C.B. | 105 | 0 | 52 | 200 | 0.46 |
| E | C.B. | 171 | 0.006 | 82 | 134 | 0.57 |
| F | C.B. | 154 | 0.006 | 72 | 130 | 0.6 |
| G | C.B. | 130 | 0.006 | 62 | 121 | 0.64 |

TABLE 2-continued

| Screen | Sub-layer | Phosphor Layer Thickness (μm) | Carbon Black (%)*2 | Phosphor ($g/m^2$) | Screen Sensitivity | CTF (5 line/mm) |
|---|---|---|---|---|---|---|
| H | C.B. | 100 | 0.006 | 50 | 110 | 0.66 |
| I | C.B. | 241 | 0.006 | 115 | 150 | 0.37 |
| J | $TiO_2$ | 166 | 0 | 81 | 263 | 0.33 |
| K | $TiO_2$ | 130 | 0 | 65 | 240 | 0.36 |
| L | $TiO_2$ | 105 | 0 | 55 | 219 | 0.4 |
| MD-100 | | — | — | — | 100 | 0.65 |

*1Carbon black

*2% by weight, based on phosphor

Using the thus prepared photographic material samples and intensifying screens, evaluation was made according to the following procedure.

Sensitivity of Intensifying Screen

Having each of intensifying screen MD-100, available from Konica Corp. and the prepared intensifying screens, A through L, combined with photographic film CM-H for use in mammography, available from Konica Corp., sensitivity of each screen was determined. X-ray exposure and photographic processing were conducted in the same manner as in the determination of average contrast. Sensitivity was represented by a relative value of: the reciprocal of X-ray exposure necessary to give a density of 1.0 plus a fog density, based on the sensitivity of screen MD-100 being 100.

Sensitivity of Photographic Combination

Sensitivity of the photographic combination of an intensifying screen and a photographic film was determined in a manner similar to the determination of average contrast. Thus, combinations of an intensifying screen and a photographic film, as shown in Table 3 were each subjected to X-ray exposure and photographic processing. Sensitivity was represented by a relative value of the reciprocal of X-ray exposure necessary to give a density of 1.0 plus a fog density, based on the sensitivity of the combination of MD-100 and CM-H (single-back) being 100.

CTF of Intensifying Screen

Having photographic film CM-H, combined with each of intensifying screen MD-100 and the prepare intensifying screens A through L, a rectangular chart for MTF measurement (Type-9, available from Kasei Optonics Co., Ltd., 40 μm thick, spatial frequencies of 0 to 10 line/mm) was brought into contact with the film side and subjected to X-ray exposure. Processing was conducted with developer solution (D) of 35° C. and fixer solution (F) of 33° C. for 90 sec. using automatic processor SRX-502, available from Konica Corp. The thus obtained chart image was subjected to densitometry with scanning, using microdensitometer PDM 6 (available from Konica Corp.). From the obtained density profile, densities of the peak and valley of a rectangular wave for each frequency were measured to determine the contrast for each frequency. The thus obtained contrasts were normalized to a contrast at a frequency of zero to determine CTF.

Evaluation of Identifying Capability

A rotary anode X-ray tube, Rotanode DRX-B1146B-Mo (available from Toshiba Electric Co. Ltd.) was employed. This X-ray tube (molybdenum target tube) was operated at 28 kVp of a three phase power source, and each of the photographic films was exposed to X-ray transmitted through 1 mm thick beryllium, 0.03 mm thick molybdenum and 2 cm thick acryl filters, from the film side. An ACR standard type 156 mammographic phantom was employed in evaluation of identifying capability. The X-ray tube, phantom and screen-film combination were arranged at varying distances $R_1$ and $R_2$, as shown in Table 1, in which $R_1$ was the distance between the focus point of the X-ray tube and the phantom, and $R_2$ was the distance between the phantom and the screen-film combination. In mammography for usual examination, a moving grid or fixed grid is used to cut scattered X-rays which deteriorates diagnosis image quality. In this invention, however, no deterioration occurs without the use thereof so that the case of using the moving grid was compared to the case of using no moving grid. A moving grid for use in mammography (produced by MITAYA SEISAKUSHO Co., Ltd.) was arranged adjacent to the phantom and opposite to the X-ray tube. Each of the exposed films was subjected to photographic processing using automatic processor SRX-502 (available from Konica Corp.) with developer solution (D) of 35° C. and fixer solution (F) of 33° C. for 90 sec. (both available from Konica Corp.).

The distance between the X-ray tube and the screen-film combination ($R_1$+$R_2$) is also shown in Table 3, the exposing X-ray dose was adjusted by varying a mAs value of the X-ray tube to determine sensitivity of the system. Sensitivity of a system was represented by a relative value of the reciprocal of X-ray exposure giving a density of 1.0 plus a fog density, based the system sensitivity of radiography No. 1 of MD-100 in combination with CM-H being 100.

Images of the thus processed films were observed on a 10,000 lux viewing box using a three-color rendering fluorescent lamp. Peripheries of the observed image were covered with processed film exhibiting a density of 3.5 or more and all samples were observed under identical conditions. Luminance was 300 lux at the position observing the viewing box.

Five bodies of nylon fiber imitating a tumor and five bodies of aluminum specks imitating micro-calcification were buried in the phantom so that images exhibiting five-steped contrasts were formed. The identifying capability was evaluated based on how many of them could be identified by the naked eye among the five bodies of from an image exhibiting the highest contrast to an image exhibiting the lowest contrast, with respect to nylon fibers imitating a tumor and aluminum specks imitating micro-calcification. Thus, with respect to nylon fibers and aluminum specks, if only one image exhibiting the highest contrast was identified, one point was provided; two points, three points and four points were successively provided, indicating the number of identified bodies; and if five images including an image exhibiting the lowest contrast were identified, five points were provided.

The point number of nylon fiber identifying capability and that of aluminum speck identifying capability were summed, radiographic image quality was evaluated based on the following rank:

| Total sum of points | Image quality rank |
|---|---|
| not more than 3 | E |
| 4 or 5 | D |
| 6 or 7 | C |
| 8 or 9 | B |
| 10 | A |

Results are shown in table 3.

TABLE 3

| Radiography No. | Photographic Material | Intensifying Screen | Distance $R_1$ (m) | $R_2$ (m) | $R_1 + R_2$ (m) | Sensitivity of Combination | Image Quality | Sensitivity of System | Remark |
|---|---|---|---|---|---|---|---|---|---|
| 1 | CM-H | MD-100* | 0.75 | 0.02 | 0.77 | 100 | C | 100 | Comp. |
| 2 | (1) | MD-100 | 0.75 | 0.02 | 0.77 | 115 | C | 115 | Comp. |
| 3 | (2) | MD-100 | 0.75 | 0.02 | 0.77 | 153 | C | 153 | Comp. |
| 4 | (3) | MD-100 | 0.75 | 0.02 | 0.77 | 210 | D | 210 | Comp. |
| 5 | (4) | MD-100 | 0.75 | 0.02 | 0.77 | 280 | D | 280 | Comp. |
| 6 | (5) | MD-100 | 0.75 | 0.02 | 0.77 | 420 | E | 420 | Comp. |
| 7 | (1) | D | 0.6 | 0.3 | 0.90 | 229 | B | 159 | Inv. |
| 8 | (2) | D | 0.6 | 0.3 | 0.90 | 305 | B | 212 | Inv. |
| 9 | (3) | D | 0.6 | 0.3 | 0.90 | 420 | B | 292 | Inv. |
| 10 | (4) | D | 0.6 | 0.3 | 0.90 | 560 | B | 389 | Inv. |
| 11 | (5) | D | 0.6 | 0.3 | 0.90 | 840 | C | 583 | Inv. |
| 12 | (1) | D | 0.75 | 0.45 | 1.20 | 229 | A | 90 | Inv. |
| 13 | (2) | D | 0.75 | 0.45 | 1.20 | 305 | A | 119 | Inv. |
| 14 | (3) | D | 0.75 | 0.45 | 1.20 | 420 | A | 164 | Inv. |
| 15 | (4) | D | 0.75 | 0.45 | 1.20 | 560 | A | 219 | Inv. |
| 16 | (5) | D | 0.75 | 0.45 | 1.20 | 840 | B | 328 | Inv. |
| 17 | (6) | D | 0.75 | 0.45 | 1.20 | 496 | A | 194 | Inv. |
| 18 | (7) | D | 0.75 | 0.45 | 1.20 | 528 | A | 206 | Inv. |
| 19 | (4) | F | 0.75 | 0.45 | 1.20 | 364 | A | 142 | Inv. |
| 20 | (4) | L | 0.75 | 0.45 | 1.20 | 613 | A | 240 | Inv. |
| 21 | (4) | L | 0.75 | 0.45 | 1.20 | 613 | B | 240 | Inv. |

*Single-back exposure

Example 2

Photographic material samples (8) through (10) were prepared similarly to sample (1) of example 1, except that the dye layer was not provided and PET film support was replaced by PEN film support. Samples were evaluated in the same manner as in example 1. Results are shown in Table 4.

TABLE 4

| Radiography No. | Photographic Material | Intensifying Screen | Distance $R_1$ (m) | Distance $R_2$ (m) | Distance $R_1 + R_2$ (m) | Sensitivity of Combination | Image Quality | Sensitivity of System | Remark |
|---|---|---|---|---|---|---|---|---|---|
| 1 | CM-H | MD-100* | 0.75 | 0.02 | 0.77 | 100 | C | 100 | Comp. |
| 2 | (8) | MD-100 | 0.75 | 0.02 | 0.77 | 280 | D | 280 | Comp. |
| 3 | (9) | MD-100 | 0.75 | 0.02 | 0.77 | 280 | C | 280 | Comp. |
| 4 | (10)** | MD-100 | 0.75 | 0.02 | 0.77 | 280 | C | 280 | Comp. |
| 5 | (8) | D | 0.65 | 0.3 | 0.95 | 560 | C | 349 | Inv. |
| 6 | (9) | D | 0.65 | 0.3 | 0.95 | 560 | B | 349 | Inv. |
| 7 | (10)** | D | 0.65 | 0.3 | 0.95 | 560 | A | 349 | Inv. |
| 8 | (8) | D | 0.9 | 0.35 | 1.25 | 560 | B | 202 | Inv. |
| 9 | (9) | D | 0.9 | 0.35 | 1.25 | 560 | A | 202 | Inv. |
| 10 | (10)** | D | 0.9 | 0.35 | 1.25 | 560 | A | 202 | Inv. |

*Single-back exposure
**Film stiffness was low and handling was rather difficult.

What is claimed is:

1. A radiographic imaging method for making a radiograph with a radiography apparatus comprising:

combining a silver halide photographic light-sensitive material with an intensifying screen to make a photographic combination, the photographic material comprising a support having a light-sensitive silver halide emulsion layer on each of both sides of the support;

exposing the photographic combination to an X-ray from an X-ray tube of the radiographic apparatus to make an exposed photographic material wherein a distance between a focal point of an X-ray tube and the photographic material is 0.9 to 3.0 m, a distance between the focal point of the X-ray tube and an object is 0.5 to 2.7 m, a distance between the object and the photographic combination is 0.3 to 1.5 m and wherein the X-ray tube is operated at a tube voltage of 15 to 150 kVp; and processing the exposed photographic material to make the radiograph.

2. The method of claim 1 wherein the photographic material comprises a support having a thickness of not less than 140 $\mu$m and the exposed photographic material exhibits a crossover of not more than 15% and an average contrast of not less than 3.4, when subjected to processing (A), wherein the processing (A) is conducted using a roller transport type automatic processor and the following developer solution (D) and fixed solution (F) at a developing temperature of 35° C. for a developing time of 24 to 28 sec. and a fixing temperature of 33° C. for a fixing time of 15 to 25 sec.:

| Developer solution D | |
|---|---|
| Water | 800 ml |
| Potassium hydroxide | 22 g |
| Potassium sulfite | 65 g |
| Hydroquinone | 27 g |
| Triethylene glycol | 20 g |

-continued

| | |
|---|---|
| 5-nitroindazole | 0.2 g |
| Acetic acid (56% aqueous solution) | 19 g |
| 1-Phenyl-3-pyrazolidone | 1.1 g |
| 5-Methylbenzotriazole | 0.05 g |

-continued

| | |
|---|---|
| Glutar aldehyde sodium bisulfite adduct | 4.0 g |
| Potassium bromide | 4.0 g |
| Water to make 1 liter | |
| pH 10.25 | |
| Fixer solution F | |
| Water | 30 ml |
| Ammonium thiosulfate (70% weight/volume) | 200 ml |
| Sodium sulfite | 14 g |
| Gluconic acid | 7 g |
| Sodium acetate trihydrate | 25 g |
| Disodium ethylenediaminetetraacetate dihydrate | 0.1 g |
| Aluminum sulfate | 16 g |
| Sulfuric acid | 3 g |
| Water to make 1 liter | |
| pH 4.55. | |

3. The method of claim 1 wherein the light-sensitive silver halide emulsion layer contains silver halide grains, at least 50% of total grain projected area being accounted for by tabular silver halide grains exhibiting an aspect ratio of not less than 2.

4. The method of claim 3 wherein the tabular grains have a grain thickness of not more than 0.5 $\mu$m.

5. The method of claim 1 wherein the support is a transparent support and layer arrangements on opposite sides of the support being identical with each other.

6. The method of claim 1 wherein the photographic combination exhibits a speed of 150 to 800.

7. The method of claim 1 wherein the intensifying screen exhibits a CTF value of 0.35 to 1.00 at a spatial frequency of 5 lines/mm.

8. The method of claim 2 wherein the light-sensitive silver halide emulsion layer contains silver halide grains, at least 50% of total grain projected area being accounted for by tabular silver halide grains exhibiting an aspect ratio of not less than 2; the photographic combination exhibiting a speed of 150 to 800; and the intensifying screen exhibiting a CTF value of 0.35 to 1.00 at a spatial frequency of 5 lines/mm.

9. A radiographic imaging method for making a radiograph with a radiography apparatus comprising:

combining a silver halide photographic light-sensitive material with an intensifying screen to form a photographic combination for making a radiograph with the radiography apparatus, wherein the photographic material comprises a support having a light-sensitive silver halide emulsion layer on each of both sides of the support, the photographic material exhibiting a cross-over of not more than 15% and an average contrast of not less than 3.4 when the photographic combination is exposed to X-ray and the photographic material is subjected to processing (A);

exposing the photographic combination to an X-ray from an X-ray tube of the radiographic apparatus to make an exposed photographic material wherein a distance between a focal point of an X-ray tube and the photographic material is 0.9 to 3.0 m, a distance between the focal point of the X-ray tube and an object is 0.5 to 2.7 m and a distance between the object and the photographic combination is 0.3 to 1.5 m;

processing the exposed photographic material by processing (A) wherein processing (A) is conducted using a roller transport type automatic processor and the following developer solution (D) and fixed solution (F) at a developing temperature of 35° C. for a developing time of 24 to 28 sec. and at a fixing temperature of 33° C. for a fixing time of 15 to 25 sec.:

| Developer solution D | |
|---|---|
| Water | 800 ml |
| Potassium hydroxide | 22 g |
| Potassium sulfite | 65 g |
| Hydroquinone | 27 g |
| Triethylene glycol | 20 g |
| 5-nitroindazole | 0.2 g |
| Acetic acid (56% aqueous solution) | 19 g |

-continued

| | |
|---|---|
| 1-Phenyl-3-pyrazolidone | 1.1 g |
| 5-Methylbenzotriazole | 0.05 g |
| Glutar aldehyde sodium busulfite adduct | 4.0 g |
| Potassium bromide | 4.0 g |
| Water to make 1 liter | |
| pH 10.25 | |
| Fixer solution F | |
| Water | 30 ml |
| Ammonium thiosulfate (70% weight/volume) | 200 ml |
| Sodium sulfite | 14 g |
| Gluconic acid | 7 g |
| Sodium acetate trihydrate | 25 g |
| Disodium ethylenediaminetetraacetate dihydrate | 0.1 g |
| Aluminum sulfate | 16 g |
| Sulfuric acid | 3 g |
| Water to make 1 liter | |
| pH 4.55. | |

10. The method of claim 9 wherein the light-sensitive silver halide emulsion layer contains silver halide grains, at least 50% of total grain projected area being accounted for by tabular silver halide grains exhibiting an aspect ratio of not less than 2.

11. The method of claim 10 wherein the tabular grains have a grain thickness of not more than 0.5 $\mu$m.

12. The method of claim 9 wherein the support is a transparent support and layer arrangements on opposite sides of the support being identical with each other.

13. The method of claim 9 wherein the photographic combination exhibits a speed of 150 to 800.

14. The method of claim 9 wherein the intensifying screen exhibits a CTF value of 0.35 to 1.00 at a spatial frequency of 5 lines/mm.

* * * * *